US006343837B1

(12) United States Patent
Gage

(10) Patent No.: US 6,343,837 B1
(45) Date of Patent: Feb. 5, 2002

(54) CHILDS STADIUM SAFETY SEAT

(76) Inventor: Ernestine Gage, 118 Douglas Dr., Jefferson City, MO (US) 65109

( * ) Notice: Subject to any disclaimer, the term of this patent is extended or adjusted under 35 U.S.C. 154(b) by 0 days.

(21) Appl. No.: 09/548,583

(22) Filed: Apr. 13, 2000

Related U.S. Application Data

(60) Provisional application No. 60/129,967, filed on Apr. 19, 1999.

(51) Int. Cl.[7] ..... A47C 1/08

(52) U.S. Cl. ..... 297/250.1; 297/170; 297/188.13; 297/378.12; 297/378.14

(58) Field of Search ..... 297/250.1, 188.13, 297/135, 170, 378.1, 378.12, 378.14, 184.13, 153, 380, 252, 464, 467, 484, DIG. 6, 440.1

(56) References Cited

U.S. PATENT DOCUMENTS 691,842 A * 1/1902 Connor
865,327 A * 9/1907 Barrett
1,163,628 A * 12/1915 Gibson
1,429,867 A * 9/1922 Goldsmith
1,739,366 A * 12/1929 Lang
2,220,865 A * 11/1940 Hines
2,418,731 A * 4/1947 Seitz
2,496,205 A * 1/1950 Grieb
2,544,896 A * 3/1951 Nidetch et al.
2,865,433 A * 12/1958 Warner
3,066,977 A * 12/1962 Boyajian
3,366,294 A * 1/1968 Stephenson
3,516,709 A * 6/1970 Nader
4,293,162 A * 10/1981 Pap et al.
4,521,052 A * 6/1985 Cone
4,685,741 A * 8/1987 Tsuge et al.
4,842,329 A * 6/1989 Owens
4,871,209 A 10/1989 Handelman ..... 297/378
5,069,503 A 12/1991 Martinez ..... 297/54
D339,695 S 9/1993 Kahl et al. ..... D6/370
5,303,979 A * 4/1994 Koyanagi et al.
5,516,193 A 5/1996 Simpson ..... 297/252
5,524,957 A * 6/1996 Gibriano
5,580,125 A * 12/1996 Alger
5,580,130 A 12/1996 Williams et al. ..... 297/352
D379,047 S 5/1997 Richard ..... D6/601
5,816,650 A * 10/1998 Lucas, Jr.

FOREIGN PATENT DOCUMENTS

GB 2172799 * 10/1986

* cited by examiner

*Primary Examiner*—Milton Nelson, Jr.
(74) *Attorney, Agent, or Firm*—Richard L. Marsh

(57) ABSTRACT

A child's stadium seat comprises of a seat portion, an upright back rest portion and safety straps to secure the child. The stadium seat securely attaches to a bench, bleacher, chair or planar seat. It contains storage space in the bottom portion of the seat, a detachable utility tray and overhead shelter from various weather conditions. When in a closed mode, the side hinges allow the top back rest to lock in position, while a storage door is located at the bottom, allowing the underneath storage area to remain closed when not in use. The child's stadium seat is elevated for viewing and consists of a bottom surface that assists in the prevention of the seat sliding.

10 Claims, 12 Drawing Sheets

50 - Bottom Outside View

52 - Storage Area

48 - Tray post slots

70- U shaped holder

74- WAIST Threading strap guides (FRONT MID Section)

CHILDS STADIUM SAFETY SEAT

CROSS-REFERENCE TO RELATED APPLICATIONS

This application is a non-provisional application under 35 U.S.C. 111(*a*) of its parent Provisional application Ser. No. 60/129,967, Filed Apr. 19, 1999.

SPECIFICATIONS

This invention is not a part of or under a government contract.

The United Stated Government has no rights to the invention of this product.

BACKGROUND OF THE INVENTION

The presentation relates to a portable stadium safety seat for children, and more Particularly, a child's Stadium Seat that convert into a child's booster seat.

PRIOR ART STATEMENT

Currently, safe and secure seating is not available for children who attend events where bleacher, plank or bench type seating is provided as a means for seating. These children are often too young or too small to place on seating that does not have the capacity to support them. Bleacher, bench or plank type seating will not hold them in an upright position or prevent them from toppling over or sliding off of this non-supportive seat. These children are most often held on someone's lap or placed in an apparatus that obstructs the path or minimizes the area needed for others to move freely about.

Children playing in the aisles that are intended for public use often cause accidents. Individuals take children to events and spend a tremendous amount of time trying to keep them safely seated. Some children are left unattended and free to roam around often times getting hurt or causing accidents.

What is needed is a way to safely and securely seat children in an apparatus that can be affixed to a bleacher, planar, chair or bench seat.

A child's stadium safety seat when used properly provides a safe means of seating the child and supporting their bodies in an upright position An additional problem exists when children are placed in chairs that are too large to accommodate their size. When sitting in a regular chair they are unable to use the table surface because their bodies sit too low to reach the table surface. Some chairs are equipped with arm rests and others are not. Regardless, children are subject to falling from the chair, thus causing needless injury.

What is needed is a seat that can be affixed to an existing chair that securely holds a child, while at the same time, elevates the child so they are able to reach the table surface. The Elevated-seating arrangement also allows them to be able to see what would ordinarily be missed without the elevated seating.

Several stadium seats have been designed for use in cooperation with a bleacher, planar or bench seat, but none possess the safety features that provides safety elements and consideration for children. For example, U.S. Pat. No. D379,047 for Foldable Bleacher Seat with securement straps; issued May 6, 1997 to Stephanie E. Richard teaches such a system. Richard teaches a cushion which may be strapped to the stadium bench. The straps are in an exterior position after folding and may be used for carrying. In contradistinction, the present invention provides strapping which feeds into the interior of the seat base at the front and then backs out through the front wall to Velcro to itself securing it in place. It also consists of safety straps to secure the child in the seat. U.S. Pat. No. D339,695 for Stadium Seat; issued Sep. 28, 1993 to Kahl, et al. teaches such a system. Kahl et al. teaches an injection molded stadium seat having reinforced ribs in the seat and back. The two parts are hinged and fold in a seat to back relationship.

The present invention on the other hand provides a hinge that allows the stadium seat when in the folded position to lock in place.

U.S. Pat. No. 5,580,130 for Seat for Bleachers; issued Dec. 03, 1996 to Williams et al. teaches a stadium seat having a cushioned seat and back rest and also has means to attach to seat structure to a stadium or bleacher bench. The attachment means can be fitted to the back as well as the front and has detent positions for fixing the seat to different bench thickness. There are no seat belt straps associated with this seat nor is there any means to carry it in the folded position.

The present invention provides seat belt straps that when reversed to the exterior of the seat can be used as a shoulder-carrying strap. The present invention when used on a chair or flat surface with a back can be strapped to the back portion to provide additional support and safety. When used in this mode, the shoulder and front middle safety belts are used to secure the child in the seat.

U.S. Pat. No. 5,516,193 for Portable Stadium Seat Apparatus; issued May 14, 1996 to Barry K. Simpson teaches a chair that clips onto the front edge of the stadium bench and fits over the back edge of the bench. The detailed embodiment is a multi-compartment shoulder bag having a similar padded seat and a vertical back support portion and a large storage compartment which extends from the seat when the unit is in position on the bench and a storage compartment which is behind the back rest when the unit is in position.

In contradistinction, the present invention threads through the interior bottom of the seat and straps to the front through a cavity opening. The present invention also provides storage capacity that is accessed through a rear door located at the back of the bottom portion of the seat. This storage area can also be used to house the detachable utility tray and connecting base for the tray. Storage is accessible whether a child is sitting in the stadium seat or not. U.S. Pat. No. 5,069,503 for Portable Collapsible Multi-purpose chair; issued Dec. 3, 1991 to Juan Martinez teaches a device that may be used as a standing chair, a bench chair or stadium bench seat. Martinez uses unshaped elements for clamping to the bench and thumbscrews with clamping pads for clamping. There are legs on the device that fold under the seat while the back is held against the seat cushion by the arms which fold over the back of the upright.

The present invention provides devices that bear no similarities to Martinez' portable collapsible multi-purpose chair.

U.S. Pat. No. 4,871,209 for Folding Stadium Seat; issued Oct. 3, 1989 to Robert Handelman teaches a device with replaceable cushions held in place with "Christmas tree" fasteners pushed through the cushion into pre-drilled holes in the molded plastic chair elements. A handle is formed in the upright elements for carrying.

The present invention on the other hand provides a model of a child's Stadium Safety Seat which allows for the seat to be safely and securely connected under a bleacher, planar, chair or stadium bench. It further provides for safety belts to assist in the support of the safety of the user.

SUMMARY OF INVENTION

The invention is a child's Stadium Safety Seat that converts to a booster seat. The seat affixes to a bleacher, bench, or plank like apparatus that is designed with or without a preexisting back rest. The invention contains a utility tray complete with a cup holder and connects at the front middle base of the bottom portion of the seat. The safety belt attaches to the seat and the waist belt becomes reversible and can be used as a shoulder carrying strap. The detachable parts of the seat are easily stored in the bottom portion of the seat through a rear door access.

The object of the invention is to provide a means of safely and securely attaching a device to a bench, bleacher, chair or planar seat, and safely and securely seat a child in the attached seat.

The invention is to provide safety belts that are affixed to the stadium seat which acts as a medium to support the child while sitting in the seat. This provides a reliable manner in which to support a child while placed in the stadium seat.

To provide a secure means of attaching the safety seat to a bench, bleacher or planar area thus providing a balanced approach of support when in use. Current seats provide connectors on one or two areas of attachable seats. The effect is the imbalance that occurs upon movement either while sitting in the seat or as one is getting out of the seat. The secure approach that the invention provides affixes the portable seat on all four corners preventing the imbalance from occurring.

When in use, the back rest portion of this invention locks in place. The locks must be manually disengaged in order to close the seat. Some current portable seats collapse with the back folding forward upon exiting the seat.

This invention contains storage space for transporting or storing objects. This allows for storage of the detachable utility tray and connecting post that is used to hold the utility tray in place. The storage space also provides a convenient means of transporting other objects.

This invention converts to a booster seat and is adaptable to a chair with a back. By the use of the mid section safety straps, these straps can be tightened around the back of a chair thereby holding the booster in place. Straps located at the bottom of the seat can be affixed around the bottom of a chair and function as an additional means of adding security when using this invention as a booster seat. Current booster seats offer little or no measure to secure the child in the seat when in use.

The invention is elevated for child viewing. The elevation provided for the child to be able to sit high enough to gain a better view. The comparative inventions do not provide the combination of high elevation for viewing and safety straps.

The utility tray quickly connects to the base of the seat through the use of a post. It contains a cup holder and provides a space for multiple purposes when in use. The tray has an upward lip which minimizes spillage from overflowing. Prior art in this format does not compare to the current invention. Some prior art in this area is extremely limited and allows little or no base for comparison.

With this invention, the waist straps can be used as a shoulder strap. The waist strap can be reversed and used as a shoulder strap. This method allows the hands to be free and provides for easier management of the child's stadium safety seat. The adjustable straps provide for flexibility and adaptability of using the straps in the front of the seat, at the back of the seat, or as a shoulder strap. This feature does not exist in comparative art.

It is one object to provide a means of affixing the child's stadium safety seat which allows adjustment to various widths of other devices that the portable seat may be affixed to.

It is one object to provide a surfaced bottom which assists in the seat remaining stationery and minimizes the frequency of the seat from sliding.

It is one object to provide a light weight child's stadium safety which makes it easy and convenient to carry.

It is one object to provide a child's stadium safety seat that is quick to connect.

It is one object to provide a child's stadium safety seat that is portable.

It is one object to provide a child's stadium safety seat that has a cushion for sitting and a cushion to be used as a backrest that are optional.

It is one object to provide child's stadium safety seat with an optional overhead shelter connection.

Further objects and advantages of my invention will become apparent from a consideration of the drawings and ensuing description.

DETAILED DESCRIPTION OF THE INVENTION

Figure 1:
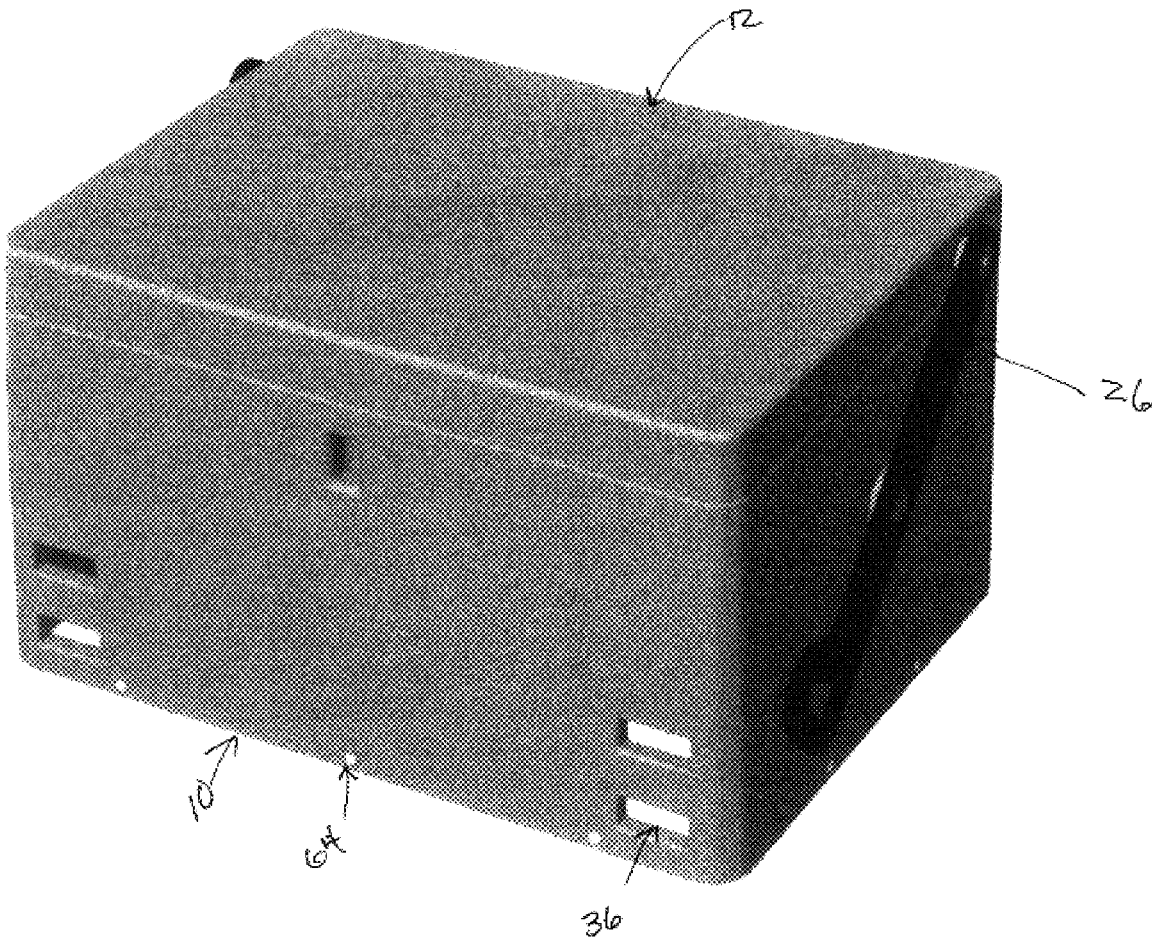
FIG. 1: It a perspective view of the preferred embodiment of the stadium seat of the invention in a closed and locked position.

The stadium seat comprises a base 10, a seat back 12, a seat back pad 14, post for utility tray 16, utility tray 18, seat bottom 20. It also comprises a bottom rear storage area 22, threading spools for bottom straps 24, side connector hinge 26, seat base hinge 28, side base connector hinge 30, top side hinge connector 32 and seat back rest hinge connector 24.

This invention relates to a stadium seat for children and more specifically a child's stadium safety seat that converts into a booster seat.

Referring to FIG. 1, there is shown a view of the stadium seat base 10, top and back 12 and side hinges 26 with the seat in a closed position.

Figure 2:
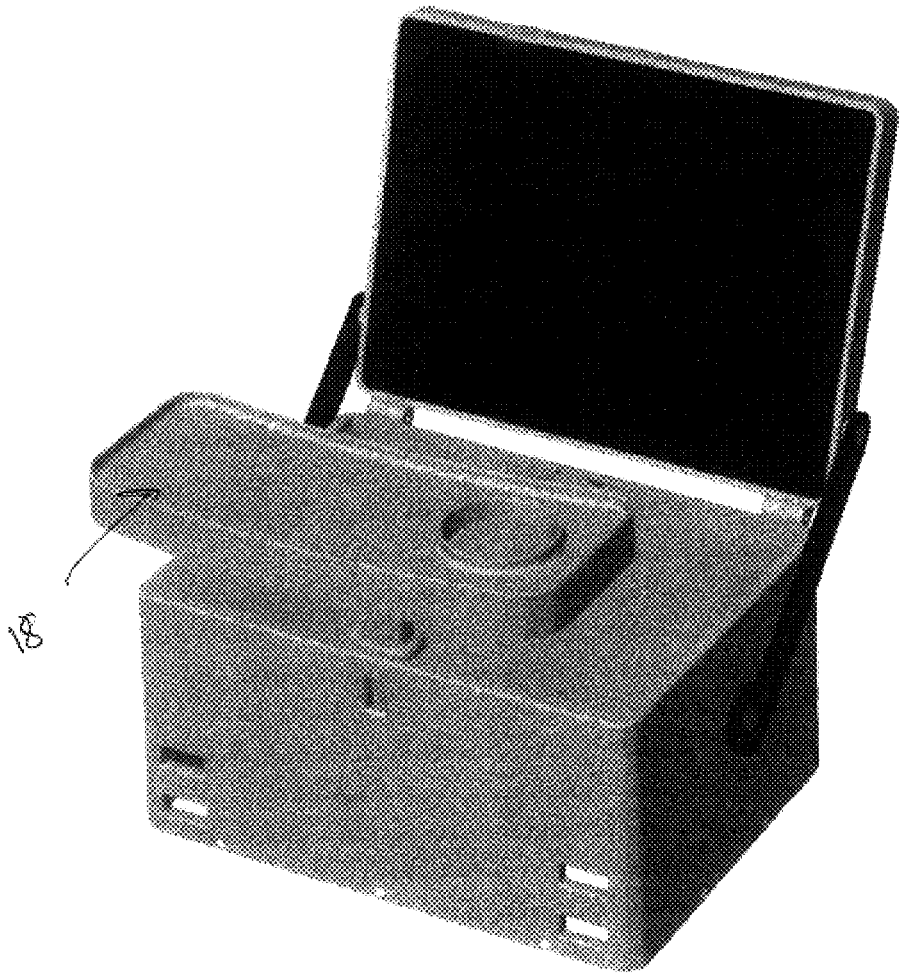
FIG. 2: Is a perspective of this invention in an open position with post and utility tray in position.

Referring now to FIG. 2, is a view of the invention in an open position displaying the optional cushion 14, the utility tray 18 and the post for utility tray 16. The utility tray 18 slides on to the top of the post 16 and is held in place by two slots 48 housed under the tray. The bottom end of the post 16 snaps on to the top front base of the seat 10. The utility tray 18 is shown with a cup holder 42.

Figure 3:
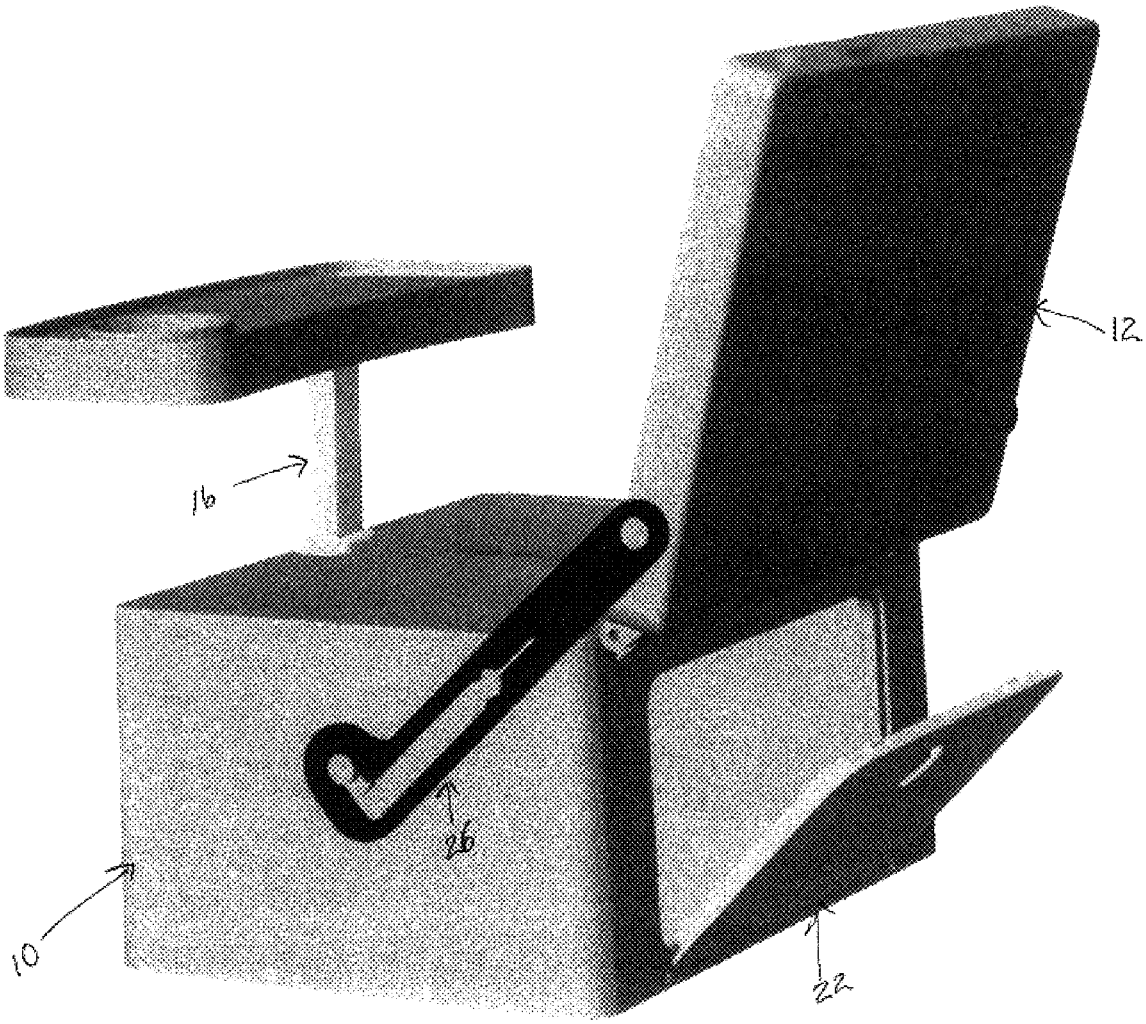
FIG. 3: Is a view of this invention displaying a rear view of the stadium seat with the rear storage door in an open position.

FIG. 3 of the invention refers to a rear view of the seat base 10 and the storage door and area 22 of the seat. The door 22 has an opening large enough to grasp the door to pull it open and shut. Knotted grooves 44 allows the door to snap in place and to remain closed.

The seating area is shown with slight indentations 46 in the top base 10 seating area. This area 46 is molded to provide comfort while sitting on the seat.

Figure 4:
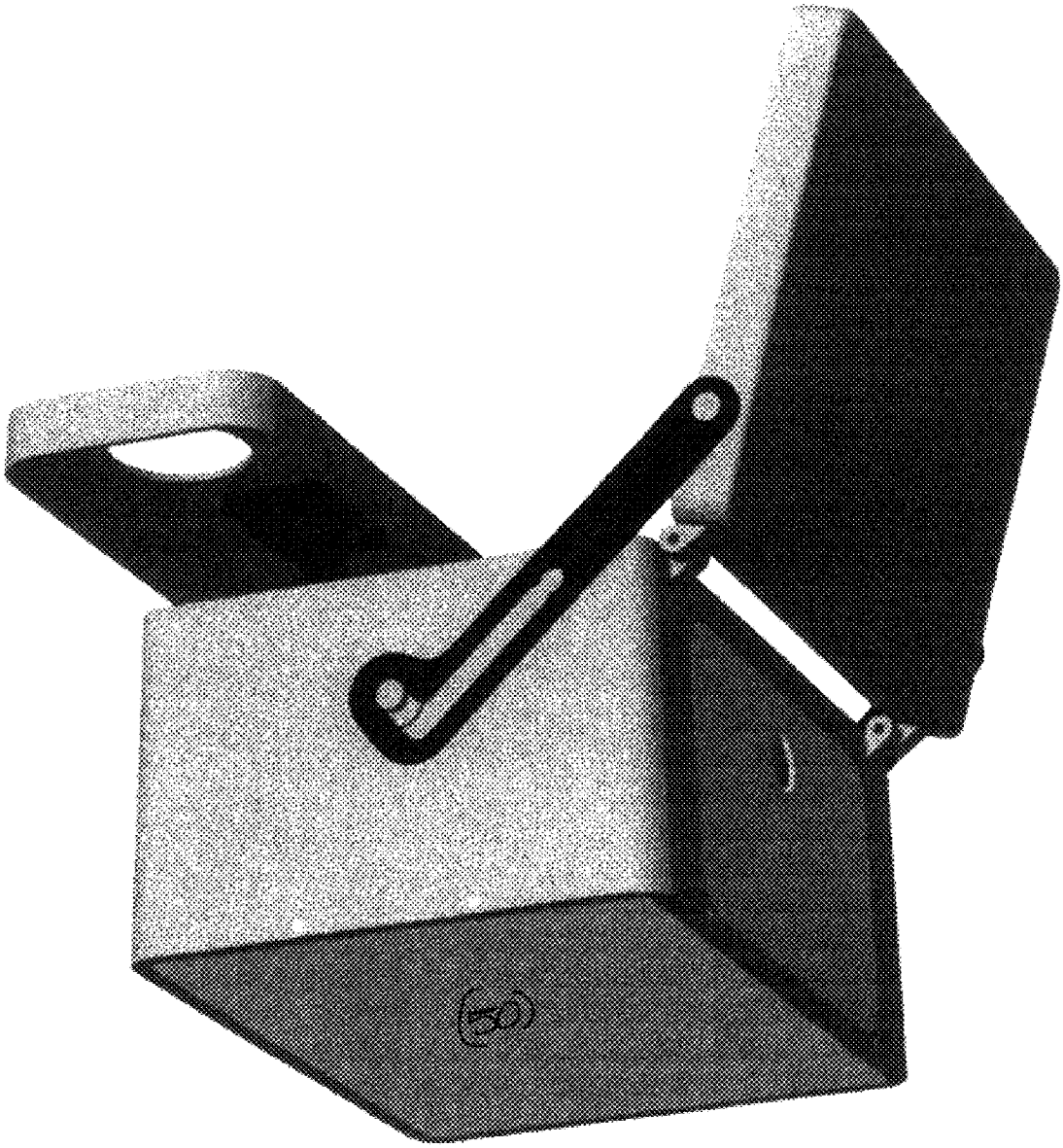
FIG. 4: Is a perspective view of the bottom of the stadium seat.

Now referring to FIG. 4 where a bottom outside view 50, of the stadium seat is shown. The view contains a substance that minimizes the seat from sliding when in use. This view also refers to two slots 48 that are used as the receivers of the top of the post 16, which connects the utility tray. The storage door 22 of same item is displayed in a closed position.

Figure 5:
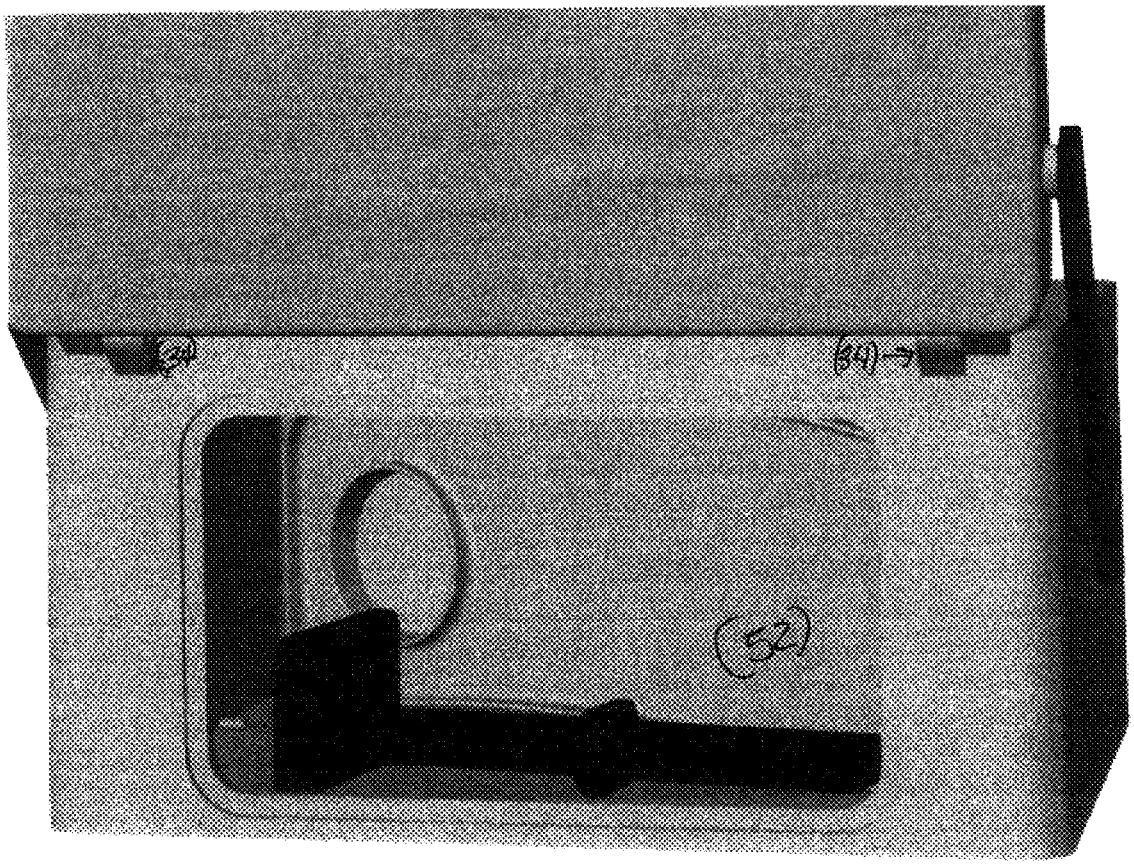
FIG. 5: Is a view of the rear open storage area which houses the post and utility tray.

Referring to FIG. 5 is shown a view of the rear opening for storage 52, for items, inclusive of the utility tray 18 and the utility post 16. When inserted from an angle, both the tray 18 and the post 16 will easily store. Space is also available to store additional items.

Figure 6:
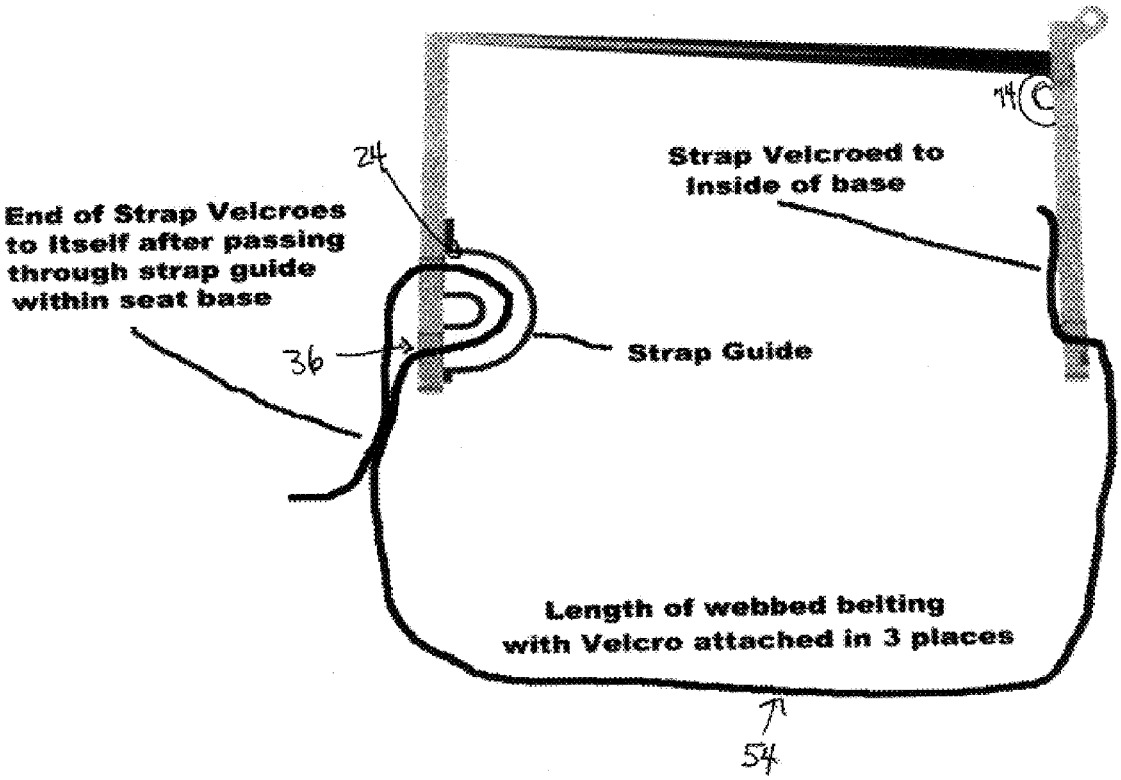
FIG. 6: Is a side view of the interior with the bottom strap thread device visible.

A preferred embodiment of the invention is shown if FIG. 6 and is shown as an interior side view of the seat base 10 which displays the method of attaching the velcro safety straps 54 to the inside base and threading strap guides 24. The straps are threaded from the inside through the threading guide entering and exiting through the open slots 36 located on the front wall of the base 10 of the seat. The velcro attaches to itself after passing through the seat guides. The use of the velcro straps allows the seat straps to be pulled to the desired tension.

Figure 7:
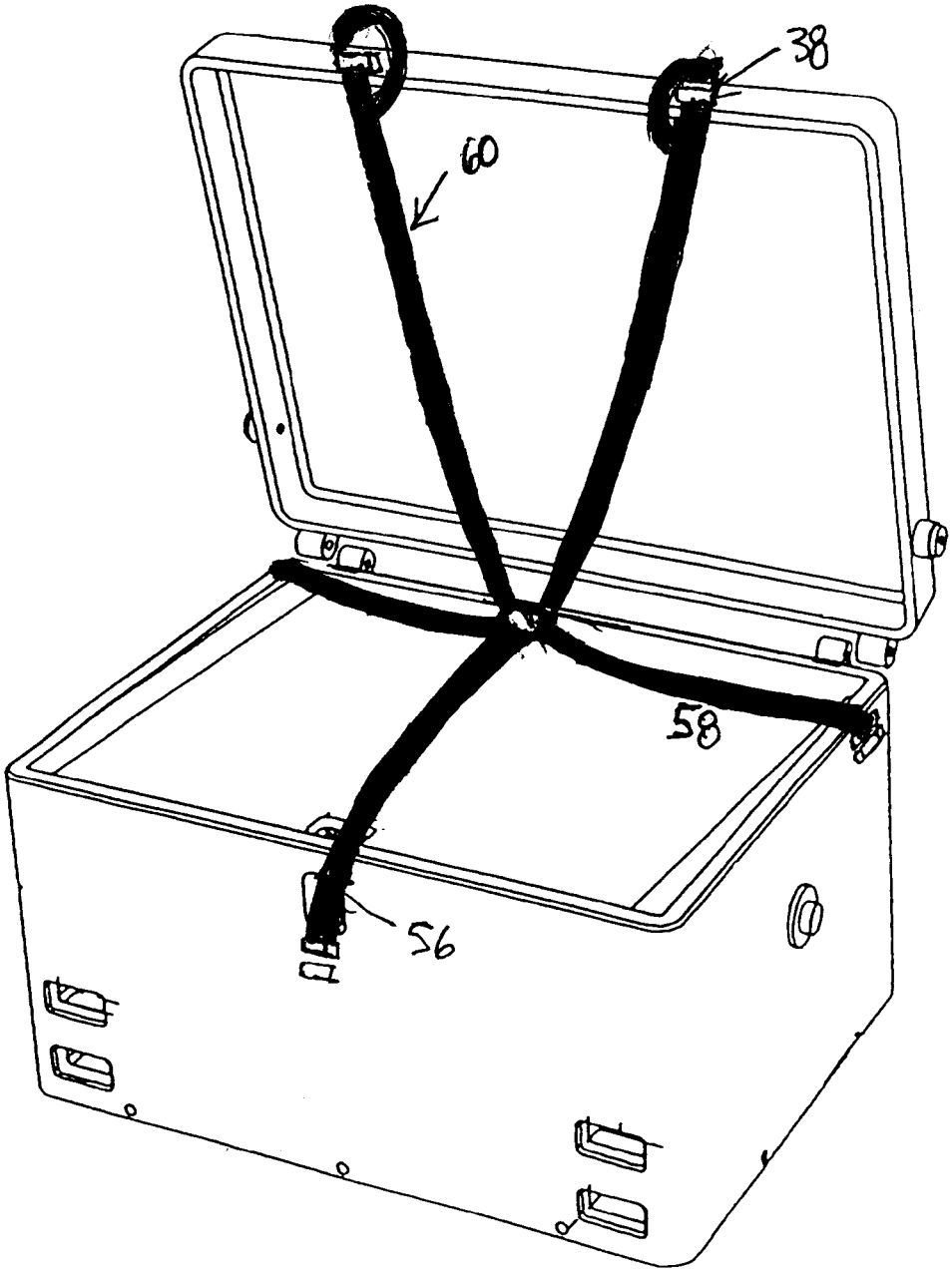
FIG. 7: Is a view of the stadium seat with anchoring points for safety belts.

Another preferred embodiment is displayed in FIG. 7 of the safety straps system. The straps are connected at center point, using the bottom middle strap as the anchor. This strap is connected to the base 10 from the front interior wall of the seat. It contains a loop at the top end of the strap that faces the seat. The loop on the strap is used as an anchor for the waist strap that threads through the loop and through a slot on the side of the seat after which it attaches to itself. The shoulder straps 60 thread through the shoulder slots 38 and attaches to itself. The other end of the strap passes over shoulder A through the anchor loop 56 and back across shoulder B before passing through the shoulder loop 38. This enables the straps to be placed with the appropriate tension.

Figure 8:
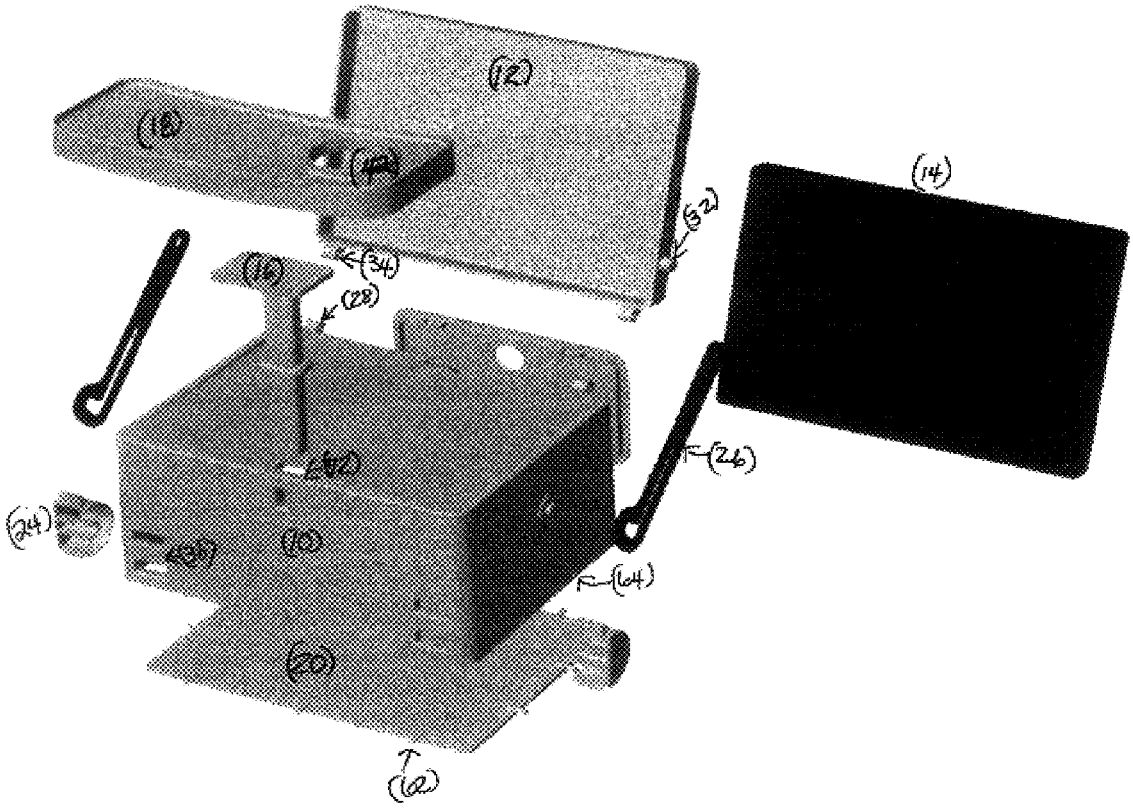
FIG. 8: Is an exploded view of the stadium seat showing the frames, pad and threading device.

An exploded view of the embodiments of the stadium seat is shown in FIG. 8. The seat is typically made of durable plastic that will withstand a variety of weather conditions.

The seat is assembled by inserting the threading devices on opposite walls of the interior sides of base 10. The interior straps 54 are pulled through the threading slots 36 at the front of the seat. The bottom panel 20 is then connected to the base 10 by properly aligning the pins 62 of bottom base 20 with the pin holes 64 of the base 10 and snapping the device in place.

The seat back pad 14 is snugly fit in the seat back top 12. The seat back top 12 is attached to the seat base 10 by inserting the seat back rest hinge connectors 34 into the seat base hinges 28. Side hinge 26 is attached to the side base hinge connector 30. The top portion of the side hinge 26 is then connected to the top side hinge connector 32. The storage area door 22 is snapped in place and held tightly in the knotted grooves 44.

The utility tray post 16 is inserted into the base post holes 72 securing it in place. The utility tray 18 slides over the tray post slots 48 located underneath the utility tray. When not in use, both the utility tray 18 and the utility tray post 16 are stored in the storage area 52.

Figure 9:
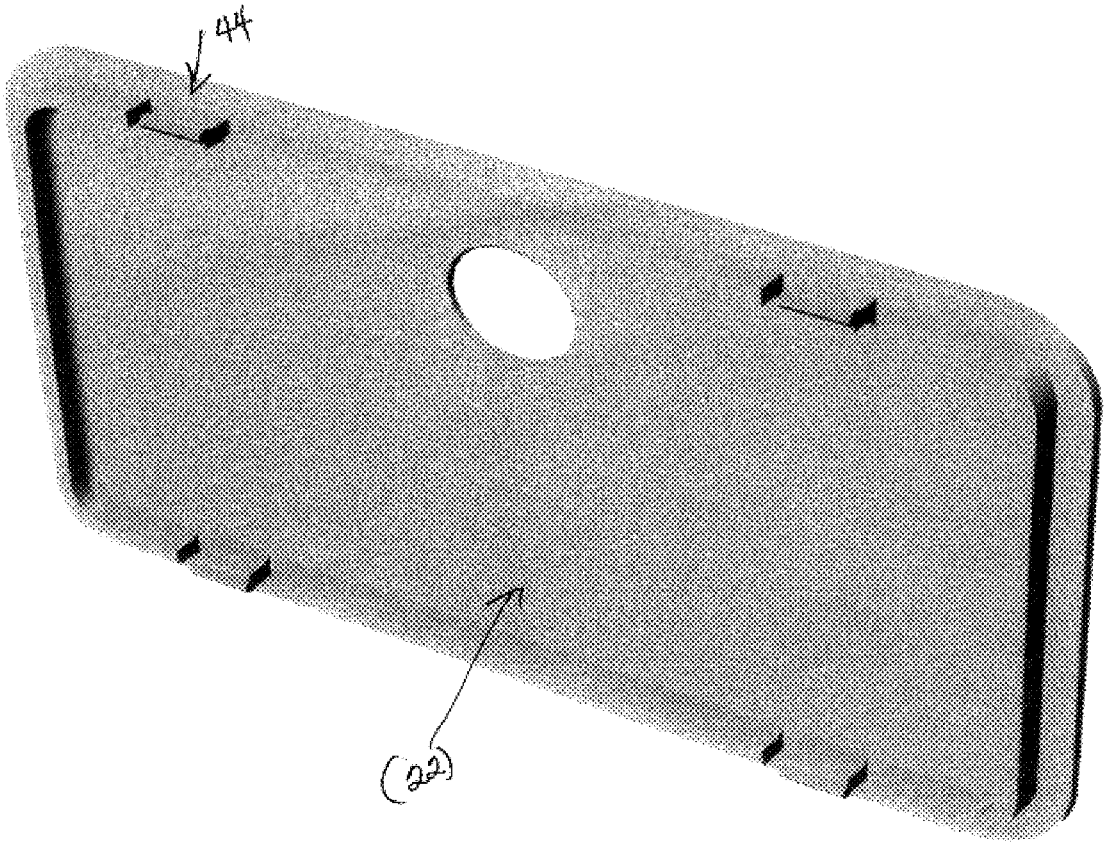
FIG. 9: Is an exploded view of the storage area door showing an enhanced view of the knotted grooves used to securely shut the door.
Figure 10:
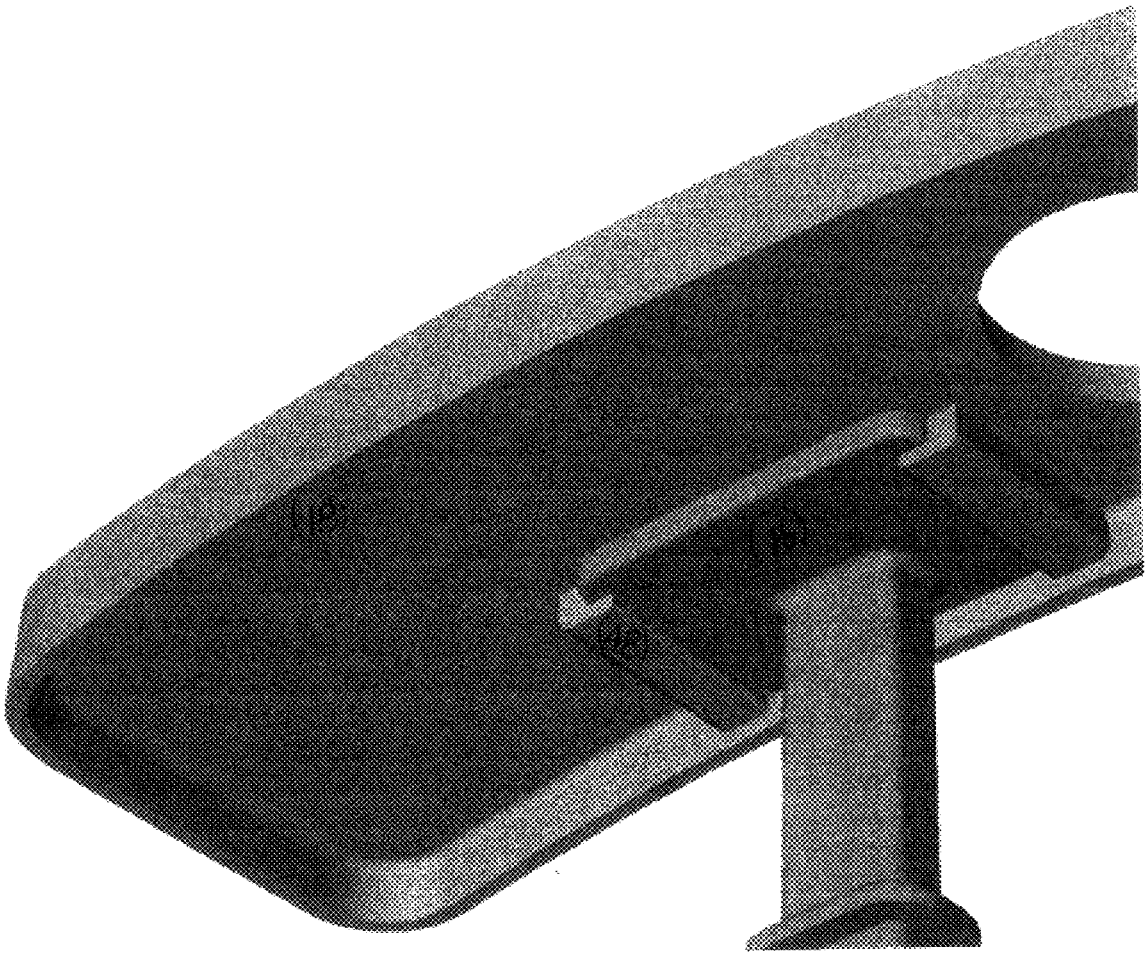
FIG. 10: Is a perspective view of the utility tray from underneath. It is an enhanced view of the tray post slots used to hold the utility post.
Figure 11:
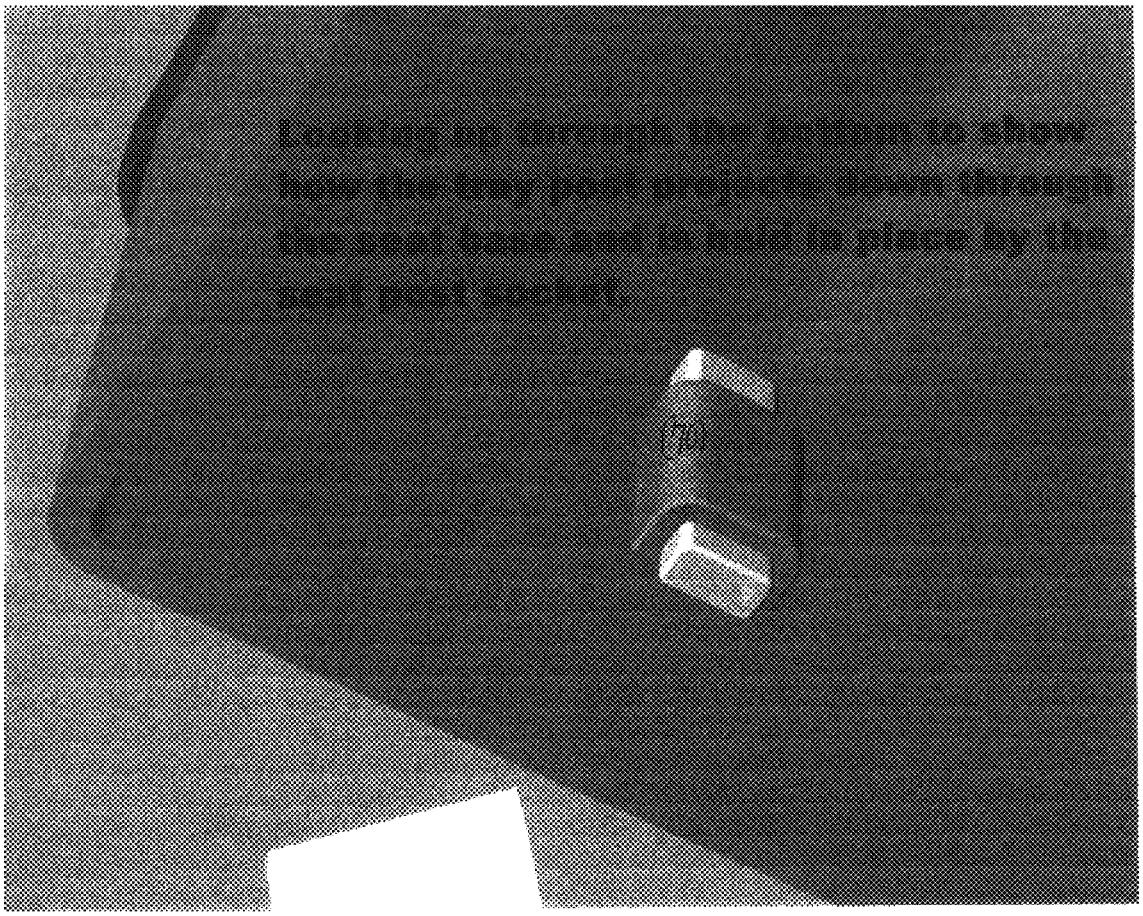
FIG. 11: Is a projection of the U-shaped ring which holds the utility post securely.
Figure 12:
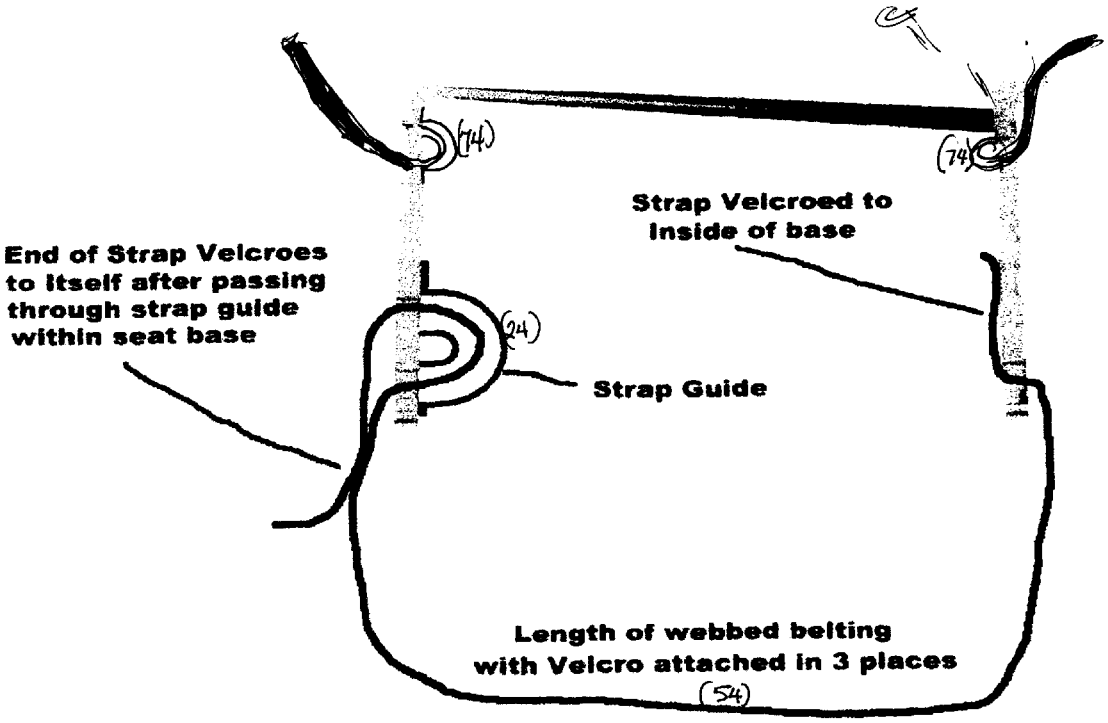
FIG. 12: A perspective view of the center anchor strap threaded through the interior threading device and exiting at the front wall cavity. This threading device is placed on both sides of the seat to guide the waist straps and in front to guide the anchor strap.

Additional embodiments are shown in FIG. 9 which is a perspective view of a detachable overhead shelter 68 that rests in the slotted area 66 of the seat top and back 12.

Possible methods of manufacturing the stadium safety seat may include but are not limited to blow molding, injection molding, vacuum molding, pressure or thermal forming.

DRAWING REFERENCE LISTING

10 Seatbase
12 Seat top and back
14 Seat back pad
16 Utility tray post
18 Utility tray
20 Bottom of seat base
22 Storage area door
24 Threading strap guides
26 Side hinge
28 Seat base hinge
30 Side base hinge connector
32 Top side hinge connector
34 Seat back rest hinge connector
36 Threading slots for bottom belt
38 Slotted openings for shoulder belts
40 Slotted openings for mid section belts
42 Cup holder
44 Knotted grooves
46 Seat indentation
48 Tray post slots
50 Bottom outside view of base
52 Storage area
54 Safety strapping method
56 Anchor safety strap
58 Mid section safety strap
60 Shoulder safety strap
62 Pins
64 Pins holes
66 Shelter post holes
68 Detachable overhead shelter
70 U-shaped post holder
72 Opening for tray post

What is claimed is:

1. A stadium seat for a child comprising a seat portion and an upright back rest portion hingedly affixed to said seat portion, said seat portion having a means for providing storage in a rear storage area disposed through a rear wall in said seat portion wherein said rear storage area has means for closure to protect items stored in said storage area wherein said means for closure comprises a substantially planar door having knotted grooves engaging said rear wall of said seat portion, said planar door further having an access hole for removing said door from said rear wall of said seat portion.

2. A stadium seat for a child as in claim 1 wherein said storage area is accessible when a child is seated upon seat portion.

3. A stadium seat for children comprising a seat portion and an upright back rest portion hingedly affixed to said seat portion, said seat portion having means for detachably affixing said stadium seat to a planar area, bleacher, chair, bench seat or plank without a preexisting back rest wherein said seat portion includes a hinged lock that supports said back rest portion in an upright position when said stadium seat is in an open position and wherein said hinged lock locks said back rest portion to said seat portion when said back rest portion is folded downwardly to overlie said seat portion.

4. A stadium seat as in claim 3 wherein said seat portion has adjustable straps for releasably securing a child to said seat portion thereby providing a safe, secure seat for a child.

5. A stadium seat as in claim 3 wherein said seat portion provides elevation to raise a child when seated upon said seat portion.

6. A stadium seat for children comprising a seat portion and an upright back rest portion hingedly affixed to said seat portion, said seat portion having means for detachably affixing said stadium seat to a planar area, bleacher, chair, bench seat or park without a pre-existing back rest, said seat portion having adjustable straps for releasably securing a child to said seat portion thereby providing a safe, secure seat for a child when seated upon said seat portion wherein said adjustable straps for releasably securing said child to said seat portion are anchored in said seat portion wherein a central adjustable strap anchored in the center front of said seat portion extends to a joining loop and wherein one strap of a pair of adjustable side straps anchored in one rear side of said seat portion passes through said joining loop upwardly toward one of a pair of slotted openings in said back rest portion and another strap of said pair of adjustable side straps anchored in an opposite rear side of said seat portion passes through said joining loop upwardly toward another of said pair of slotted openings in said back rest portion.

7. A stadium seat as in claim 6 wherein each of said pair of adjustable side straps has one end thereof releasably secured upon a portion of said end with a hook and loop fastener.

8. A stadium seat as in claim 6 wherein each of said pair of adjustable side straps cooperates with said central strap to secure a child when seated upon said seat portion onto said seat portion and said back rest portion wherein said central strap passes between the legs of a child when seated upon said seat portion, said one adjustable side strap passes over one shoulder of a child when seated upon said seat portion and said other adjustable side strap passes over the other shoulder of a child when seated upon said seat portion.

9. A stadium seat as in claim 6 wherein upon removing a child seated upon said seat portion from said seat portion, said joining loop is pulled forwardly allowing said back rest portion to fold downwardly and overlie said seat portion and be lockably secured thereto, said pair of adjustable side straps and said central strap comprising means for carrying said stadium seat.

10. A stadium seat as in claim 9 wherein at least one of said pair of adjustable side straps is adapted to be placed over one shoulder of a person carrying said stadium seat.

* * * * *